US005208730A

United States Patent [19]

Tracy

[11] Patent Number: 5,208,730

[45] Date of Patent: May 4, 1993

[54] COMPUTER COOLING FAN VIBRATION ISOLATION APPARATUS

[75] Inventor: Mark S. Tracy, Tomball, Tex.

[73] Assignee: Compaq Computer Corporation, Houston, Tex.

[21] Appl. No.: 967,704

[22] Filed: Oct. 28, 1992

Related U.S. Application Data

[62] Division of Ser. No. 721,996, Jun. 27, 1991.

[51] Int. Cl.[5] ..... F04D 29/66

[52] U.S. Cl. ..... 361/384; 415/119; 415/213.1; 361/427; 361/429

[58] Field of Search ..... 415/119, 213.1, 214.1, 415/220; 361/384, 427, 429

[56] References Cited

U.S. PATENT DOCUMENTS

| | | | |
|---|---|---|---|
| 1,476,776 | 12/1923 | Stamm et al. | 415/119 |
| 4,568,243 | 2/1986 | Schubert et al. | 415/119 |
| 4,750,860 | 6/1988 | Kelley | 415/119 |
| 4,819,503 | 4/1989 | Fazi, Jr. et al. | 415/119 |
| 4,834,615 | 5/1989 | Mauch et al. | 415/213.1 |
| 4,899,254 | 2/1990 | Ferchau et al. | 361/384 |
| 5,079,438 | 1/1992 | Heung | 361/384 |

FOREIGN PATENT DOCUMENTS

| | | | |
|---|---|---|---|
| 20458 | 2/1982 | Japan | 361/384 |

*Primary Examiner*—Edward K. Look
*Assistant Examiner*—Michael S. Lee
*Attorney, Agent, or Firm*—Konneker & Bush

[57] ABSTRACT

To isolate a computer housing structure from vibration created by an internal cooling fan, the fan is provided with a pair of specially designed resilient vibration isolation members. In one embodiment, the vibration isolation members each comprise a spaced pair of pocketed end portions having generally triangular cross-sections and joined by a thin strip of resilient material. These end portions are fitted onto the corners of the fan's rectangular outer frame which is then pushed forwardly into a rectangular mounting frame, the pocketed isolation member end portions serving to space the inserted fan frame apart from the mounting frame. The rear side of the mounting frame is then secured to an inner side surface of the computer housing structure. In another embodiment, a pair of elongated resilient vibration isolation members are removable mounted on opposite outer side edge portions of a rectangular mounting frame into which the rectangular fan frame is removably inserted. The mounting frame has a pair of resilient barb structures, projecting downwardly from its bottom side, which are snapped into suitably configured openings in a printed circuit power supply board disposed within a portion of the computer housing structure. Contiguous wall portions of the computer housing structure portion press inwardly against the installed vibration isolation members which function to firmly hold the cooling fan in place and substantially reduce the amount of fan vibration transmitted to the computer housing structure.

8 Claims, 4 Drawing Sheets

COMPUTER COOLING FAN VIBRATION ISOLATION APPARATUS

This is a division of application Ser. No. 07/721,996, filed Jun. 27, 1991 pending.

BACKGROUND OF THE INVENTION

1. Field of the Invention

The present invention relates generally to cooling fans, and more particularly relates to the attenuation of vibration and resulting noise associated with internal computer cooling fans.

2. Description of Related Art

To prevent an interior heat buildup which could potentially damage their internal electronic operating components, various types of personal computers are typically provided with one or more internal cooling fans. Each fan normally operates while the computer is running to continuously draw ambient air into the computer housing structure through a housing air intake opening, flow the air generally across the operating components to absorb heat generated thereby, and then discharge the heated air from the interior of the housing through a suitable air discharge opening formed therein.

Despite the fact that they are usually rather small, computer cooling fans can generate an undesirable amount of vibration, and attendant housing structure vibration noise, if care is not taken to properly isolate them from the interior computer housing support structure upon which they are mounted. To this end, various fan mounting structures have heretofore been utilized in an attempt to isolate the computer housing structure from fan vibration and thereby attenuate fan vibration-created noise during computer operation.

In one conventional configuration thereof, a computer cooling fan has a rectangular frame structure in which the fan motor and impeller are operatively mounted between open inlet and outlet sides of the frame. The four peripheral walls of the frame, which border its open inlet and outlet sides, are relatively thin. However, to provide for mounting of the frame within the interior of a computer housing, the four corner portions of the rectangular frame are diagonally thickened. Small circular bores are formed through these thickened corner portions of the frame.

To mount the conventional cooling fan just described within the interior of a computer housing structure, eight resilient annular grommet members are provided, each of the grommet members having an axially projecting hollow tubular central stem portion formed thereon. At each thickened corner portion of the fan frame two of these stem portions are manually pushed into the front and rear ends of the corner portion bore so that the radially enlarged annular portions of the two grommets are positioned against the front and rear side surfaces of the frame corner portion.

The fan frame is then pushed forwardly into a rectangular plastic mounting frame having inwardly projecting pins formed on front side corner portions thereof. These four plastic pins enter the four resilient grommets on the front side of the fan housing in a manner resiliently supporting the fan within the mounting housing. With the fan installed in this manner within the mounting housing, the rectangular outer periphery of the fan frame is spaced inwardly from the rectangular inner periphery of the mounting frame, and the enlarged annular portions of the four resilient grommets on the outlet side of the fan housing project a small distance outwardly beyond the rear side of the mounting frame. The rear side of the mounting frame is then fastened against an interior side portion of the computer housing structure, over an air inlet opening formed therein, to slightly axially compress all of the resilient grommets.

As a general proposition, this method of mounting the cooling fan within a computer housing yields satisfactory performance from the standpoint of vibration and noise reduction. However, from structural and installation standpoints it has several limitations and disadvantages. For example, the manual installation of the eight resilient grommets, and the subsequent blind insertion of the mounting housing pins into the inlet side grommets, tend to be tedious and time-consuming tasks. Additionally, particularly when the fan is removed from the mounting housing, one or more of the small grommets can be easily become dislodged from the fan housing and be lost.

Another problem associated with this conventional cooling fan mounting technique is that the fan vibrational forces transmitted to the support pins on the mounting housing sometimes cause one or more of the pins to fatigue and break, thereby materially reducing the vibration isolation capabilities of the overall mounting structure. Furthermore, the four inlet side grommets provide effective vibration damping only in an axial direction.

It can readily be seen from the foregoing that a need exists for improved vibration isolating mounting apparatus for internal computer cooling fans. It is accordingly an object of the present invention to provide such improved apparatus.

SUMMARY OF THE INVENTION

The present invention provides improved apparatus, and associated methods, for resiliently mounting a cooling fan within an interior housing portion, such as a sheet metal chassis structure, of a computer. The cooling fan is illustratively of a conventional construction and configuration and comprises a generally rectangular fan frame having diagonally inwardly enlarged corner sections through which circular openings are formed, and a motor-driven fan impeller operatively mounted in the fan frame.

In one embodiment thereof, the improved resilient mounting apparatus comprises a generally rectangular mounting frame into which the fan frame may be nestingly inserted through an open rear side of the mounting frame. Before such insertion, the fan frame corner sections are covered with four pocketed vibration isolation members formed from an elastomeric material. Subsequent to the insertion of the fan frame, and the vibration isolation members thereon, into the mounting frame, the vibration isolation members engage front wall corner portions of the mounting frame, are at least slightly compressed between the facing exterior and interior peripheries of the fan and mounting frames, and preferably project rearwardly beyond the open rear side of the mounting frame.

Means are provided for securing the open rear side of the mounting housing to an inner side surface of the interior housing portion of the computer, thereby resiliently isolating the cooling fan from the interior housing portion of the computer. To facilitate the installation of the four vibration isolation members on the fan housing, first and second pairs of the vibration isolation members are each preferably connected to the opposite ends of a pair of elongated joining members also formed from an elastomeric material.

In another embodiment thereof, the improved resilient mounting apparatus of the present invention comprises a rectangular mounting frame having first and second opposite sides, and third and fourth opposite sides. Means are provided for removably attaching the rectangular fan frame to the mounting frame in a side-by-side, generally aligned relationship therewith.

A pair of elongated vibration isolation members, formed from an elastomeric material, are outwardly secured to the third and fourth mounting frame in parallel relationships therewith. The fan and mounting frame assembly are positioned within the interior housing portion in a manner such that the vibration isolation members engage and are laterally compressed by opposite side walls of the interior housing portion of the computer.

The lengths of the vibration isolation members are preferably sized in a manner such that outer end portions of the installed vibration isolation members project outwardly beyond the second side of the mounting frame and are engaged by and at least slightly longitudinally compressed by a third side wall of the interior housing portion of the computer.

In accordance with another feature of the invention, the first side of the mounting frame is provided with outwardly projecting connection means which are received in opening means formed in a printed circuit board disposed within the interior housing portion, the connection means functioning to releasably secure the mounting frame to the circuit board.

DETAILED DESCRIPTION

Figure 1:
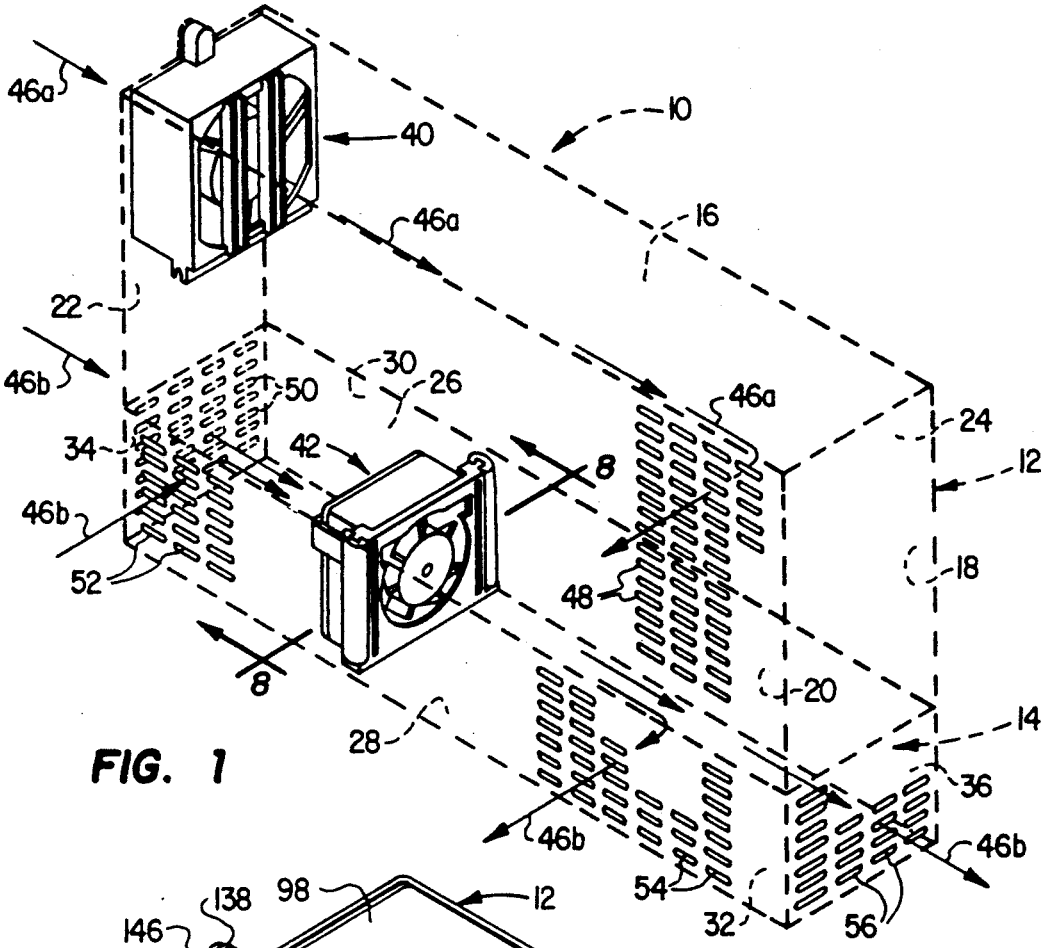
FIG. 1 is a simplified perspective view, partially in phantom, of a metal interior housing chassis portion of a representative personal computer in which a pair of cooling fans are internally mounted utilizing vibration isolation apparatus embodying principles of the present invention.

Illustrated in phantom in FIG. 1 is a sheet metal interior chassis housing portion 10 of a personal computer, representatively in the form of an AC-powerable portable computer. Chassis portion 10 is disposed within an outer housing portion of the computer (not shown) and includes an elongated rectangular upper chassis section 12 positioned generally as shown atop an elongated rectangular lower chassis section 14.

Upper chassis section 12 has a top wall 16, front and rear side walls 18 and 20, and left and right end walls 22 and 24. Lower chassis section 14 has top and bottom walls 26 and 28, front and rear side walls 30 and 32, and left and right end walls 34 and 36. Central processing system components (not shown) are operatively disposed within upper chassis section 12, and power supply system components, including a printed circuit power supply board 38 resting on bottom chassis wall 28 (FIG. 8), are operatively disposed within lower chassis section 14.

The computer operating components housed within the upper and lower chassis sections 12, 14 are respectively cooled by upper and lower cooling fan assemblies 40 and 42. As schematically illustrated in FIG. 1, the fan assembly 40 is mounted in an upper left corner of the upper chassis section 12 over a spaced series of air inlet openings 44 (FIG. 3) in chassis end wall 22. Inlet openings 44 are positioned inwardly adjacent an air intake formed in the previously mentioned outer housing portion of the computer. During operation of the fan assembly 40, ambient air $46_a$ is flowed rightwardly through the upper chassis section 12 and then forced outwardly therefrom through a spaced series of discharge openings 48 formed in a right end portion of the rear chassis side wall 20. The lower fan assembly 42 is positioned within a longitudinally intermediate portion of the lower chassis section 14. During operation of the fan assembly 42, ambient air $46_b$ is drawn into the lower chassis section 14 through a series of inlet openings 50 in the left chassis end wall 22, and a series of air inlet slots 52 formed in a left end portion of the rear chassis side wall 32. The ambient air $46_b$ is then flowed through the fan assembly 42 and forced outwardly through spaced series of air outlet slots 54,56 respectively formed in a right end portion of the rear chassis section side wall 32 and the right chassis section end wall 36.

Turning now to FIGS. 2–5, the upper fan assembly 40 includes a cooling fan 60 (FIG. 3) having a motor-driven impeller 62 operatively supported within a rectangular plastic fan frame 64. Frame 64 has open inlet and outlet sides 66 and 68, and diagonally inwardly thickened upper corner portions 70 and 72, and lower corner portions 74 and 76, each having a small circular bore 78 extending therethrough between the inlet and outlet sides of the frame 64. Extending inwardly from the periphery of the rectangular frame 64 is a partial inlet side wall 80 (FIG. 5) which borders a circular air inlet opening 82 in the frame 64.

Figure 3:
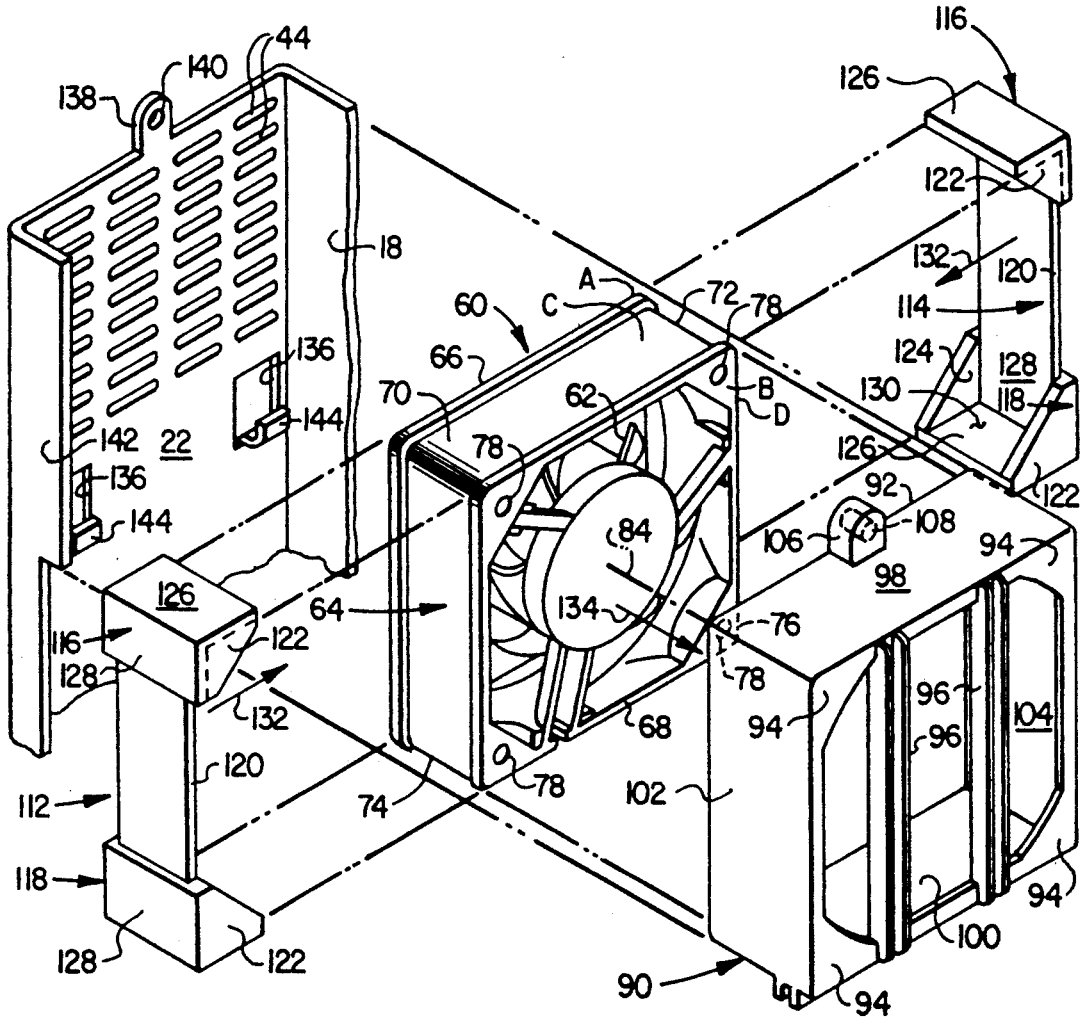
FIG. 3 is an exploded perspective view of the upper cooling fan assembly.

As representatively shown for the top right frame corner portion 72 in FIG. 3, each of the thickened frame corner portions 70,72,74 and 76 has four outer side surface portions—inlet and outlet side surface portions A and B which face in opposite directions parallel to the rotational axis 84 of the fan; a vertically facing peripheral surface portion C; and a horizontally facing peripheral surface portion D.

Figure 2:
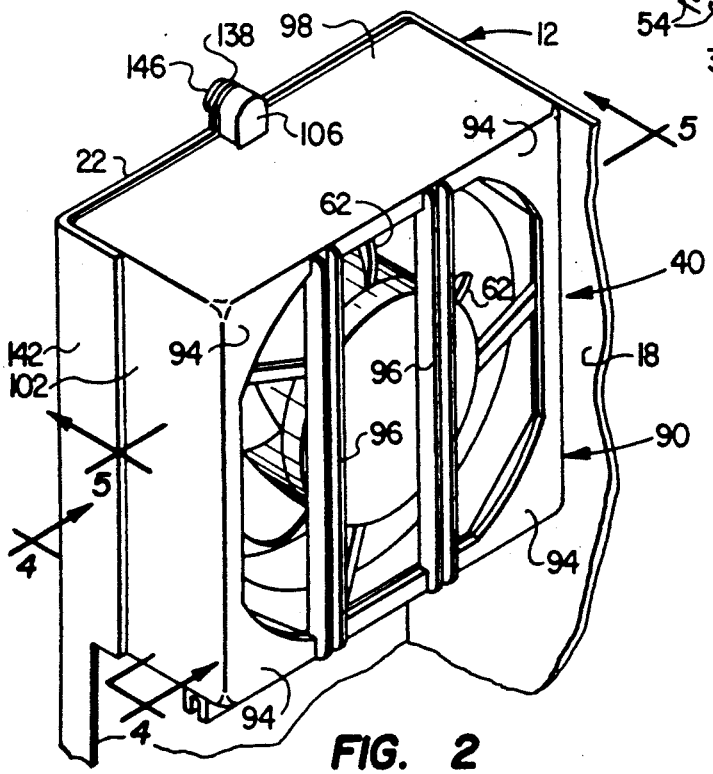
FIG. 2 is an enlarged scale perspective view of the upper cooling fan assembly shown in FIG. 1.
Figure 5:
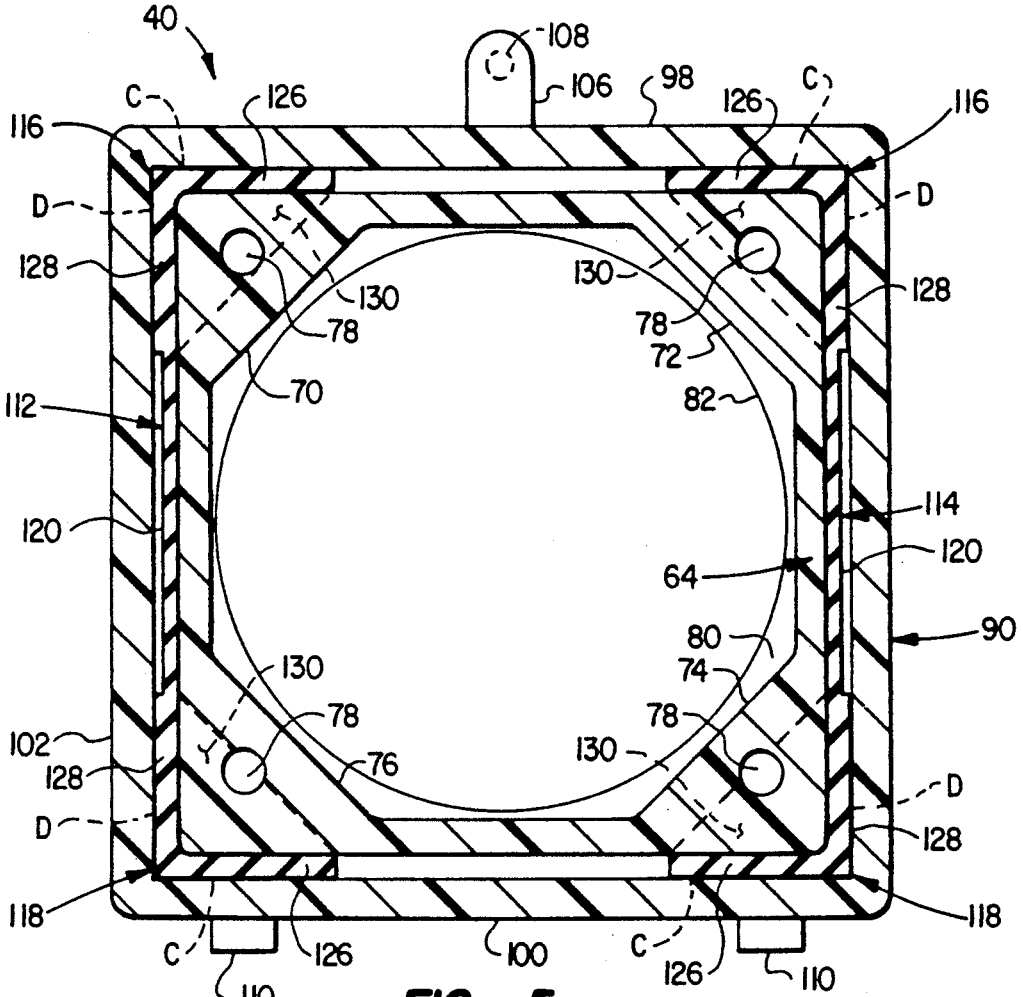
FIG. 5 is an enlarged scale cross-sectional view through the upper cooling fan assembly taken along line 5—5 of FIG. 2, with the motor and impeller portions of the fan having been removed for illustrative purposes.

As best illustrated in FIGS. 2, 3 and 5, the upper fan assembly 40 also includes a rectangular mounting frame 90 having an open rear side 92, an open front side with generally triangular corner wall portions 94 and a pair of vertical reinforcing portions 96, top and bottom side walls 98 and 100, and left and right side walls 102 and 104. For purposes later described, a mounting tab 106 having a circular opening 108 formed therethrough projects upwardly from the top housing wall 98 adjacent its rear side edge. Additionally, a spaced pair of tabs 110 project downwardly from the bottom housing wall 100 adjacent its rear side edge.

According to an important feature of the present invention, the upper fan assembly 40 also includes a pair of uniquely configured vibration isolation members 112 and 114 which, as viewed in FIG. 3, have vertically elongated configurations. Each of the vibration isolation members 112,114 is preferably molded from a suitable elastomeric material (such as rubber or neoprene) and includes upper and lower pocketed sections 116,118 which are interconnected by an elongated joining strip 120.

Each of the upper and lower sections 116,118 has a pair of generally triangularly shaped front and rear side walls 122 and 124 joined to the opposite side edges of a pair of perpendicular horizontal and vertical side walls 126 and 128. The four walls of each of the upper and lower sections 116,118 define therein a pocket 130 which, with the upper fan assembly components in their illustrative FIG. 3 orientations, open outwardly toward one of the corner portions 70,72,74,76 of the fan frame 64.

The vibration isolation members 112,114 are installed on the fan frame 64 simply by moving them inwardly toward the fan frame, as indicated by the arrows 132 in FIG. 3, to snugly position each of the four fan frame corner portions in one of the vibration isolation member pockets 130 as cross-sectionally illustrated in FIG. 5. The opposite end sections 116,118 of each of the vibration isolation members 112,114 are sized in a manner such that they frictionally retain themselves on their associated fan frame corner portions. With the resilient opposite end sections 112,114 installed on the fan frame 64 in this manner, the walls 124,122,126 and 128 of each of the end sections 116,118 respectively extend across the outer surface portions A,B,C and D of the particular end section's associated fan frame corner portion.

The fan frame 64, with the resilient vibration isolation members 112,114 operatively installed thereon, is then pushed forwardly (i.e., rightwardly) into the mounting frame 90 as indicated by the arrow 134 in FIG. 3. Such rightward insertion of the fan frame 64 into the mounting frame 90 positions the walls 122 of the opposite vibration isolation member end sections against the inner sides of the front corner wall portions 94 of the mounting frame 90. Additionally, as shown in FIG. 5, it slightly compresses the resilient walls 126,128 between the fan frame corner surface portions C and D and interior corner surface portions of the mounting frame 90 to thereby frictionally retain the fan frame 64 within the mounting frame 90.

As can be best seen in FIG. 5, this resiliently isolates the fan frame 64 against direct contact with the mounting frame 90. The elongated joining strips 120 are preferably made somewhat thinner (in a left-to-right direction as viewed in FIG. 5) than the vibration isolation member walls which they connect. Accordingly, only the opposite end sections 116,118 of the vibration isolation members are vertically and horizontally compressed and operate to resiliently support the fan frame 64 within the mounting frame 90. With the fan frame operatively positioned within the mounting frame, the resilient end section walls 124 project slightly rearwardly from the mounting frame 90 as illustrated in phantom in FIG. 4.

Figure 4:
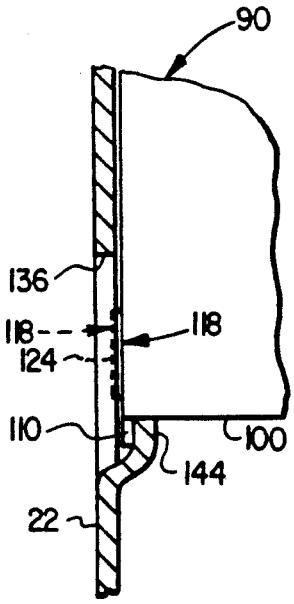
FIG. 4 is an enlarged scale, simplified partial cross-sectional view through the upper cooling fan assembly taken along line 4—4 of FIG. 2.

Referring now to FIGS. 2–4, the chassis end wall 22 has a horizontally spaced pair of rectangular openings 136 therein; a mounting tab 138 projecting upwardly from a central portion of its top edge and having a circular opening 140 therein; an inwardly bent left side edge portion 142; and a pair of inwardly offset, upturned support lips 144 at the bottom sides of wall openings 136.

The mounting housing 90 is operatively secured over the air inlet openings 44 in chassis wall 22 by positioning the mounting housing tabs 110 behind the support lips 144 (FIG. 4) and then leftwardly pivoting the mounting housing 90 until it reaches its FIG. 2 position in which it is closely received between the chassis wall portions 18,142 and the mounting tabs 106,138 are brought into alignment with one another. Tabs 106,138 are then secured to one another using a screw 146, thereby firmly locking the upper fan assembly 40 in place. Tightening of the screw 146 operates to force the outwardly projecting portions of the resilient walls 124 (FIG. 4) against the inner side of the chassis wall 22 and rightwardly compress them.

With the upper fan assembly 40 in its operatively installed position shown in FIG. 2, the fan frame 64 is resiliently isolated from both the mounting housing 90 and the upper chassis section 12 by the opposite end portions 116,118 of the vibration isolation members 112 and 114. Importantly, in contrast to the grommet inserts conventionally used in this mounting application, these pocketed end portions 116,118 function, without the use of fatigue-prone support pin members, to resiliently restrain vibrational motion of the fan frame 64 in opposite directions parallel to the fan axis 134 (FIG. 3), and in all directions transverse to the fan axis. This latter resilient restraint of the fan frame 64 is advantageously present at both the inlet and outlet sides thereof.

The use of the two simple resilient vibration isolation members 112, 114 in place of the eight grommet insert members customarily utilized renders the overall installation of the upper fan assembly 40 both easier and more rapid, and the members 112, 114 provide a stronger and more effective resilient mounting for the cooling fan structure.

As mentioned above, the joining strips 120 conveniently function to connect the opposite pairs of pocketed isolator sections 116, 118 and to help hold them in place on their associated corner portions of the fan frame 64. Accordingly, there are only two resilient mounting pieces needed. If desired, however, these joining strips could be eliminated, leaving the four pocketed sections to be separately installed. Alternatively, if desired, two additional joining strips could be utilized to respectively join the two upper pocketed sections 126, and the two lower pocketed sections 128, to thereby provide a single, generally rectangular isolation member which could be stretched and then snapped into place around the periphery of the fan frame 64.

Turning now to FIGS. 6–9, the lower fan assembly 42 includes a hollow rectangular plastic fan frame 150 which internally supports a fan motor 152 drivingly connected to a bladed fan impeller 154 rotatable about the fan axis 156. In its FIG. 7 orientation, fan frame 150 has open inlet and outlet sides 158 and 160; top and bottom sides 162 and 164; left and right sides 166 and 168; diagonally inwardly enlarged top corner portions 170; and diagonally inwardly enlarged bottom corner portions 172. Circular openings 174 extend through these enlarged corner portions between the inlet and outlet sides 158, 160 of the fan frame 150.

Lower fan assembly 42 also includes a generally rectangular plastic mounting frame 176 having an open top side; a front side wall 178 with a generally circular opening 180 therein; left and right side walls 182, 184 projecting rearwardly from opposite vertical side edges of the wall 178; and a bottom wall 186 projecting rearwardly from a lower side edge portion of wall 178. Extending vertically along the outer sides of walls 182 and 184, between bottom wall 186 and the top edge of front wall 178, are a pair of generally triangularly cross-sectioned projections 188. Spaced apart pairs of resilient connection prong members 192, 194 project downwardly from the underside of the bottom wall 186. A pair of elongated holding members 194, having inturned outer end portions 196, project rearwardly from upper end portions of side walls 182 and 184. For purposes later described, a pair of generally triangularly cross-sectioned detent members 198 project rearwardly from front wall 178 just above bottom wall 186.

Figure 6:
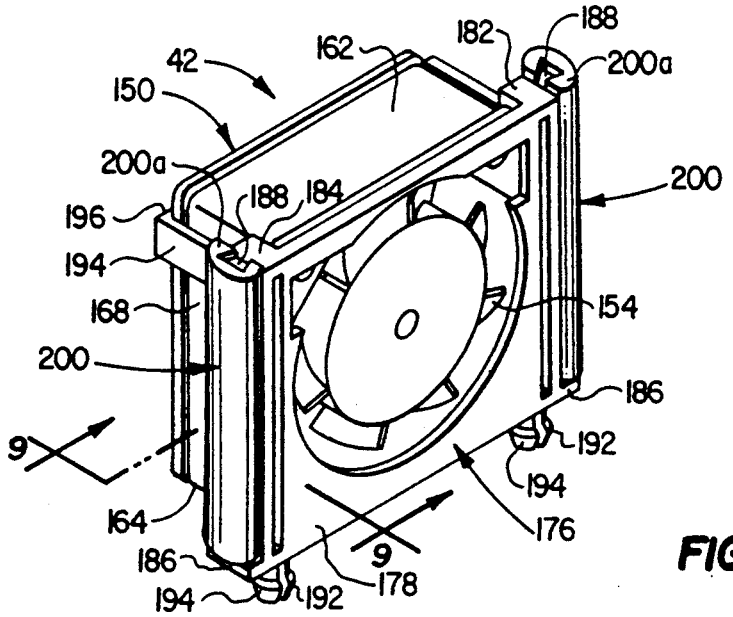
FIG. 6 is an enlarged scale perspective view of the lower cooling fan assembly shown in FIG. 1.
Figure 7:
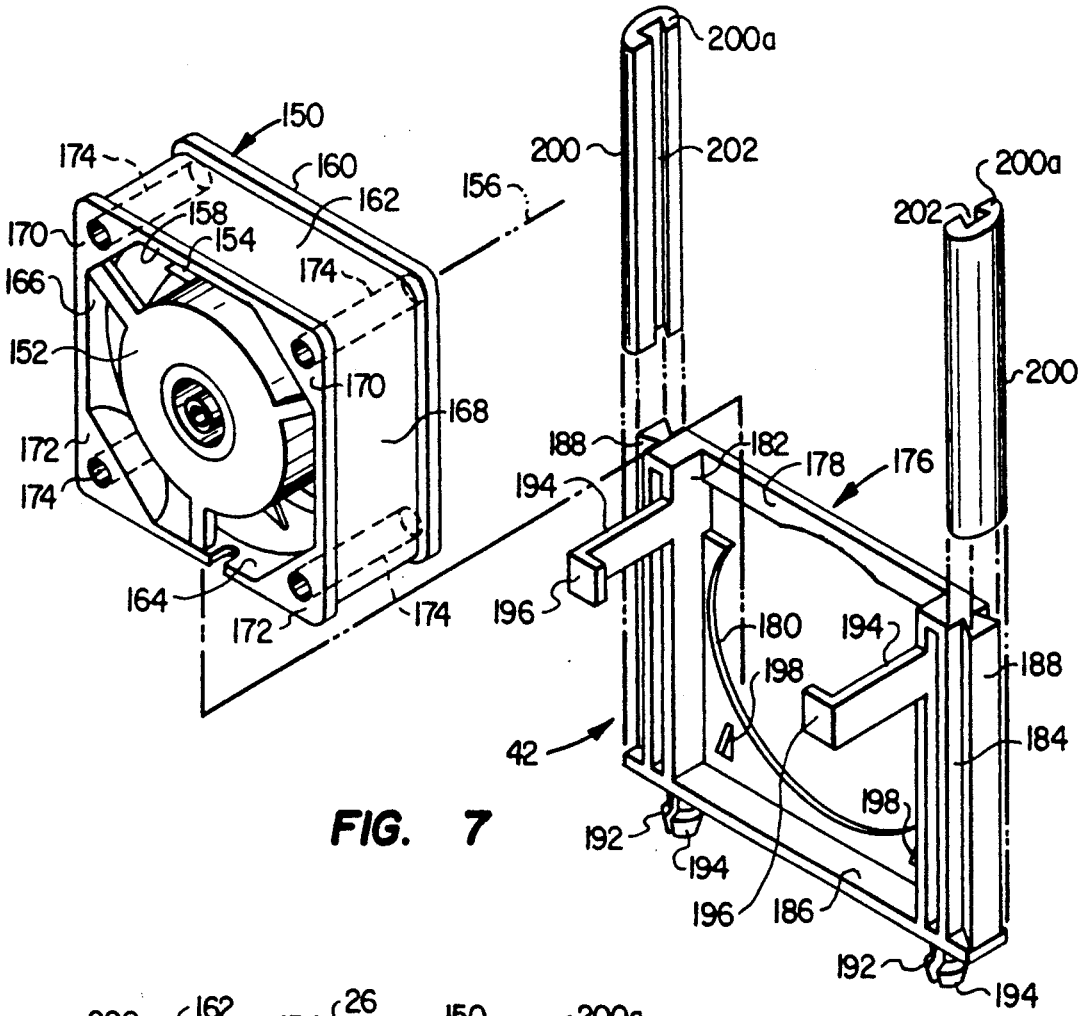
FIG. 7 is an exploded perspective view of the lower cooling fan assembly.

The fan frame 150 is removably installed within the mounting frame 176 simply by moving the fan frame downwardly through the open upper end of the mounting frame until the lower wall 164 of the fan frame 150 bottoms out against the lower side wall 186 of the mounting frame 176 as shown in FIG. 6. The mounting frame 176 is configured in a manner such that the installed fan frame 150 is closely received therein, with the front wall 178 and inturned outer end portions 196 of the mounting frame respectively engaging the front and rear sides of the fan frame, and the left and right side walls 182, 184 and the holding members 194 engaging the opposite sides 166, 168 of the fan frame 150. As the fan frame 150 bottoms out against the lower wall 186 of the mounting frame, the detent members 198 snap into place within the two bottom corner openings 174 of the fan frame (see FIG. 9) to thereby releasably retain the fan frame within the mounting frame.

As in the case of the previously described upper fan assembly 40, the lower fan assembly 42 is provided with two vertically elongated resilient vibration isolation members 200 (FIG. 7) molded from a suitable elastomeric material such as rubber or neoprene. Vibration isolation members 200 have generally semicircular cross-sections along their lengths, and have generally triangularly cross-sectioned vertical grooves 202 formed in their flat sides and extending between the top and bottom ends of the vibration isolation members.

The vibration isolation members 200 are removably installed on the mounting frame 176 by inserting the upper ends of the frame projections 188 into the lower ends of the isolation member grooves 202 and then sliding the isolation members downwardly along the projections 188 until the lower ends of the isolation members bottom out against the lower mounting frame wall 186. When this bottoming out occurs, upper end portions $200_a$ of the isolation members upwardly project slightly beyond the upper side edge of the front mounting frame wall 178 as best illustrated in FIGS. 6 and 8.

Figure 8:
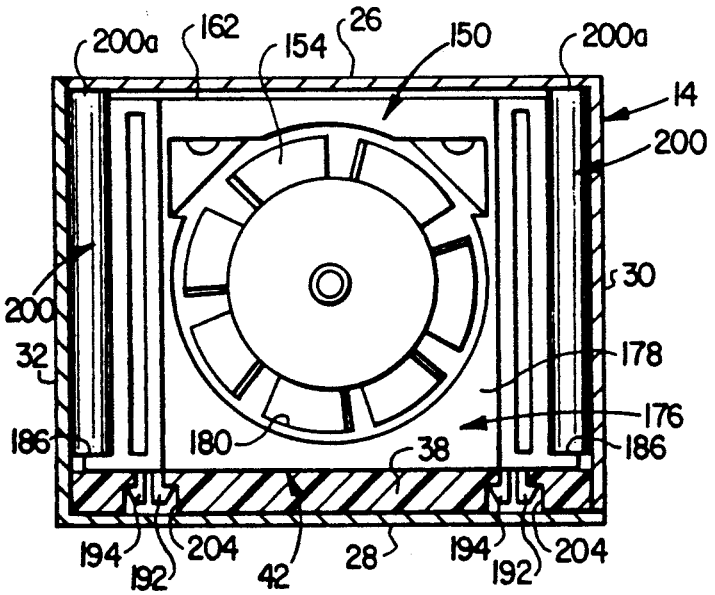
FIG. 8 is an enlarged scale cross-sectional view through a bottom portion of the housing chassis taken along line 8—8 of FIG. 1 and illustrating the lower cooling fan assembly in frontal elevation.
Figure 9:
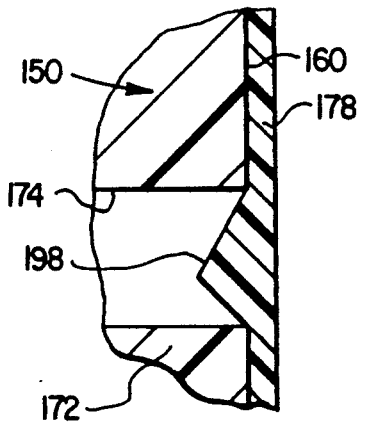
FIG. 9 is an enlarged scale, simplified partial cross-sectional view through the lower cooling fan assembly taken along line 9—9 of FIG. 6.

As cross-sectionally illustrated in FIG. 8, the perpendicular wall pairs 28, 32 and 26, 30 of the lower chassis section 14 are integrally formed and are removably joined to one another in a suitable manner along their contiguous outer side edge portions to give the lower chassis section its illustrated rectangular cross-section along its length. The completed lower fan assembly 42 is operatively mounted within the lower chassis section 14 by temporarily removing the wall structure 26, 30 from the wall structure 28, 32 and then simply snapping the resilient barb member pairs 192, 194 into appropriately configured openings 204 formed in the power supply board 38 as shown in FIG. 8. As viewed in FIG. 8, this positions the outer side surface of the left vibration isolation member 200 against the inner side of the chassis wall 32.

The chassis wall section 26, 30 is then rejoined to the chassis wall section 28, 32. This rejoining causes chassis wall 30 to press leftwardly against the right vibration isolation member 200 and cause the two vibration isolation members 200 to be slightly compressed between the vertical chassis walls and vertical side edge portions of the mounting frame 176. It also causes the upper chassis wall 26 to slightly compress the upper end portions $200_a$ of the vibration isolation members 200.

The vibration isolation members 200 installed in this manner very efficiently isolate the lower chassis section 14 from fan vibration, and attendant vibration noise, and also substantially reduce the amount of fan vibration transmitted to the power supply board 38. The vibration isolation members 200, like the previously described vibration isolation members 112 and 114, are inexpensive to manufacture and may be quickly and easily installed.

The foregoing detailed description is to be clearly understood as being given by way of illustration and example only, the spirit and scope of the present invention being limited solely by the appended claims.

What is claimed is:

1. A method of resiliently mounting a cooling fan within an interior housing portion of a computer, said interior housing portion having a rectangular cross-section defined by first and second opposite side walls and third and fourth opposite side walls, and said cooling fan having a generally rectangular fan frame portion, said method comprising the steps of:

providing a generally rectangular mounting frame having first and second opposite outer peripheral sides and third and fourth opposite peripheral outer sides;

removably securing said fan frame to said mounting frame in a generally side-to-side aligned relationship therewith;

respectively securing first and second elongated resilient vibration isolation members outwardly on and parallel to said third and fourth peripheral outer sides of said mounting frame;

positioning said mounting frame in said interior housing portion;

laterally compressing said first vibration isolation member between said third side wall of said interior housing portion and said third outer peripheral side of said mounting frame; and laterally compressing said second vibration isolation member between said fourth side wall of said interior housing portion and said fourth outer peripheral side of said mounting frame.

2. The method of claim 1 wherein said first side wall of said interior housing portion has a printed circuit board positioned against its inner side in a parallel relationship therewith and said method further comprises the steps of:

forming a transverse opening in said printed circuit board, forming an outwardly projecting connection structure on said first peripheral outer side of said mounting frame, and inserting said connection structure into said printed circuit board opening.

3. The method of claim 1 wherein said first and second vibration isolation members have outer end portions which longitudinally project outwardly beyond said second peripheral outer side of said mounting frame and said method further comprises the step of:

causing said second side wall of said interior housing portion to longitudinally inwardly press against said outer end portions of said first and second vibration isolation members.

4. The method of claim 1 further comprising the steps of:

forming elongated, generally triangularly cross-sectioned projections along the lengths of said third and fourth outer peripheral sides of said mounting frame, forming elongated slots along the lengths of said first and second vibration isolation members, each of said slots being configured to complementarily receive one of said elongated projections, and wherein said securing step if performed by inserting said projections into said slots.

5. In a computer having an interior housing portion with a generally rectangular cross-section defined by first and second opposite side walls and third and fourth opposite side walls, a resiliently mounted cooling fan assembly disposed within said interior housing portion and comprising:

a rectangular mounting frame having first and second opposite outer peripheral sides respectively parallel to said first and second opposite side walls of said interior housing portion, and third and fourth opposite outer peripheral sides respectively parallel to said third and fourth opposite side walls of said interior housing portion;

a cooling fan including a rectangular fan frame having a motor-driven fan impeller operatively mounted therein;

means for releasably securing said fan frame to said mounting frame in a side-by-side, generally aligned relationship therewith; and vibration isolation means for reducing the amount of cooling fan vibration transmitted to said interior housing portion of the computer, said vibration isolation means including:

first and second elongated vibration isolation members formed from an elastomeric material, said first and second vibration isolation members, respectively, being outwardly secured to said third and fourth peripheral outer sides of said mounting frame in parallel relationships therewith, said first vibration isolation member being laterally compressed between said third side wall of said interior housing portion and said third peripheral outer side of said mounting frame, and said second vibration isolation member being laterally compressed between said fourth side wall of said interior housing portion and said fourth peripheral outer side of said mounting frame.

6. The resiliently mounted cooling fan assembly of claim 5 wherein:

the computer has a printed circuit board positioned against the inner side of said first side wall of said interior housing portion in a parallel relationship therewith, said printed circuit board having a mounting opening extending transversely therethrough, and said first peripheral outer side of said mounting frame has connection means projecting outwardly therefrom, said connection means being received in said printed circuit board opening and functioning to releasably connect said mounting frame to said printed circuit board.

7. The resiliently mounted cooling fan assembly of claim 5 wherein:

said first and second vibration isolation members have outer end portions engaged and longitudinally compressed by said second side wall of said interior housing portion of the computer.

8. The resiliently mounted cooling fan assembly of claim 5 wherein:

said fan frame has a pair of corner openings therein, said mounting frame has a pair of front wall corner portions, and said means for releasably securing said fan frame to said mounting frame include a pair of arm members extending rearwardly from said mounting frame along opposite sides of said fan frame and having inturned outer ends extending along a rear side portion of said fan frame, and a pair of detent projections extending rearwardly from said front wall corner portions of said mounting frame and received in said pair of fan frame corner openings.

* * * * *